United States Patent [19]

Smarsly et al.

[11] Patent Number: 4,599,215

[45] Date of Patent: Jul. 8, 1986

[54] PROCESS AND DEVICE FOR PRODUCING COMPRESSED MOULDINGS FROM LOOSE OR SINTERED METAL POWDER

[76] Inventors: Wilfried Smarsly, Magazinstrasse 32, D-5000 Köln 90; Karl J. Grundhoff, Spitzwegstrasse 4, D-5210 Troisdorf; Hartmut Schurmann, Dorfstrasse 176, D-5204 Lohmar-Krahwinkel, all of Fed. Rep. of Germany

[21] Appl. No.: 674,596

[22] Filed: Nov. 26, 1984

[30] Foreign Application Priority Data

Nov. 30, 1983 [DE] Fed. Rep. of Germany ..... 3343210

[51] Int. Cl.[4] ..... B22F 1/00

[52] U.S. Cl. ..... 419/42; 419/38; 419/49; 419/66; 419/67; 419/68; 264/572; 425/78; 425/405 R; 425/405 H; 425/408

[58] Field of Search ..... 419/38, 30, 42, 66, 419/67, 49, 68; 425/78, 405 H, 405 R, 408; 264/572

[56] References Cited

U.S. PATENT DOCUMENTS 2,783,504 3/1957 Hamjian et al. ..... 419/42

2,847,708 8/1958 Hamjian et al. ..... 419/42

3,577,635 5/1971 Bergman et al. ..... 419/42

3,771,221 11/1973 Bachmann et al. ..... 419/42

4,435,360 3/1984 Trottier et al. ..... 419/42

*Primary Examiner*—Stephen J. Lechert, Jr.

*Attorney, Agent, or Firm*—Spensley Horn Jubas & Lubitz

[57] ABSTRACT

A hermetically sealed capsule (10) containing degased metal powder (11) is embedded in a soft metal flow die (20). Subsequently the flow die (20) is compressed in a cavity block, thereby compressing the metal powder (11) by the hydrostatic pressure of the flow die and simultaneously shaping the said powder. This results in the reforming of the structure right down to the interior of the particles with compression of up to 100%. The shaping process can be aided by moulding dies (17, 18) embedded in the flow die (10) around the capsule (10) at a distance from each other and, when closed, forming a cavity, the shape of which deviates from that of the original shape of the capsule (10). The capsule (10) containing the metal powder is formed during closure of the moulding cavity.

18 Claims, 10 Drawing Figures

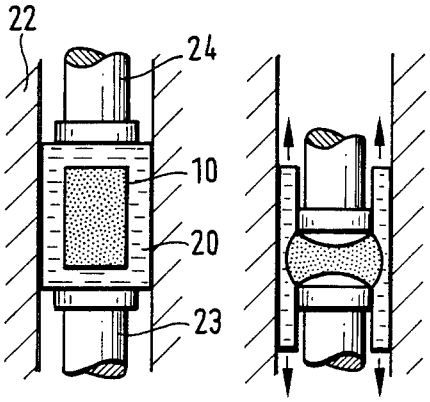
FIG. 6a 6b)
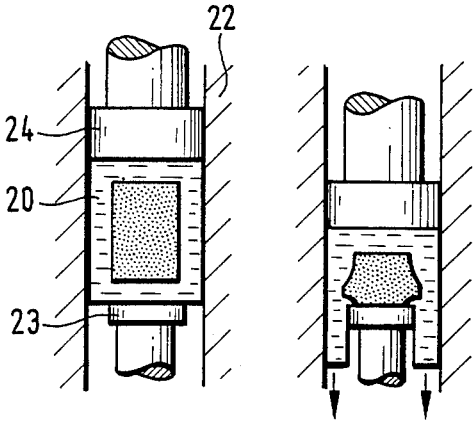
FIG. 7a 7b)
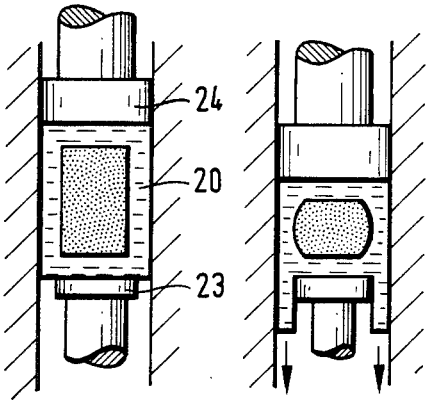
FIG. 8a 8b)
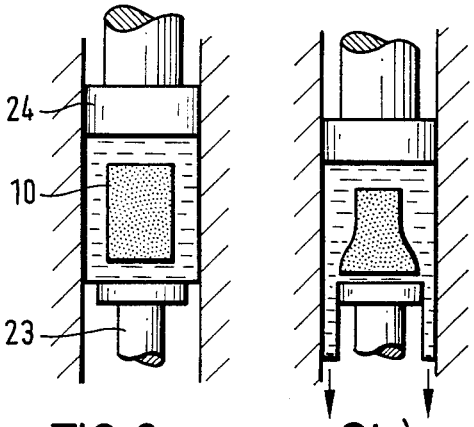
FIG. 9a 9b)
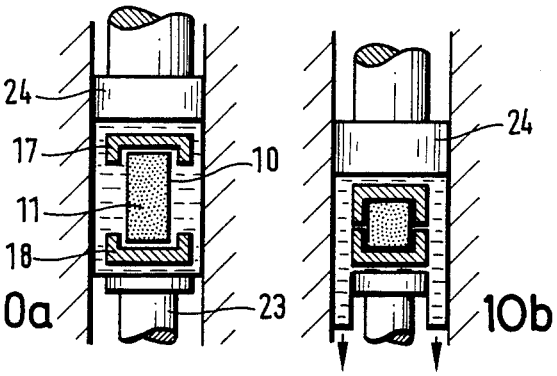
FIG. 10a 10b

PROCESS AND DEVICE FOR PRODUCING COMPRESSED MOULDINGS FROM LOOSE OR SINTERED METAL POWDER

The subject of this invention is a process for producing compressed mouldings from loose or sintered metal powder, especially from titanium alloys, where the metal powder is evacuated in a capsule and the filled capsule subsequently compressed, using the pressure of an operating medium, and also a device for carrying out this process.

Known processes for the compression and shaping of metal powder are hot-isostatic pressing, vacuum hot-pressing, flow-die-compression, powder-forging and special semi-finishing processes such as powder rolling and powder extrusion. Hot-isostatic pressing, vacuum hot-pressing and flow-die compression are processes which require only one production stage in order to produce make near-component forms from the encapsulated powder by the action of pressure and temperature. The most important aspect of the said processes is the compression and sintering of the powder, and not the actual shaping, so that the structure is generally of a more inferior quality than that achieved with a forging process where there is a suitably high degree of shaping, which in turn usually means that the quality of the material is worse. The sintered powder mouldings are recompressed when using powder-forging in order to achieve a 100% density, but here too the existing degrees of shaping are low. With this method, shaping is achieved by means of a forging die. Although the semi-finishing processes generally result in a good structure, they are not suitable as methods of producing near-components, where the powder or semi-finished product is turned into a component as near as possible to its final shape, using only one stage of production.

The known compression and shaping processes, such as hot-isostatic pressing or powder-forging, are unable to reshape the structure down to the interior of the powder particles, but only reshape the edges of the powder particles and press them into the pores.

The invention is designed to create a process of the type mentioned at the beginning, allowing mouldings with a reshaped structure extending to the interior of the particles and consequently possessing greater mechanical strength, especially with regard to vibratory stress.

The invention has solved this particular problem by using a soft metal flow die as the operation medium. This is partially displaced from the pressure chamber during the application of pressure, thereby causing the metal to compress as well as shaping the same.

The process as designed by this invention not only effects a compression of the metal powder, it simultaneously achieves the shaping of the powder material deep into the particle interior, using great pressure and application of the flow die. Defined forms can be produced with improved material quality and a reduction in the number of process stages, compared with conventional processes.

The shape of the moulding to be produced depends, among other things, on the form given to the metal powder in the capsule, but also on the type and direction of the displacement of flow-die material from the compression mould. There are components which receive their raw shape from the specific effect and deformation through the flow die. However, if the parts to be produced have more complicated forms or if greater dimensional accuracy is required, then the process as envisaged by this invention can be extended so that at least one dimensionally stable moulding die can be fitted into the flow die, with the capsule differing from the shape of the moulding die.

The moulding die embedded in the flow die achieves a shaping action and to some extent also guides the deformation process in the direction of the component to be produced. On the other hand, the shape of the capsule containing the metal powder must not have exactly the same shape as the moulding die, otherwise the powder would not undergo adequate deformation during the compression process. Therefore the forms of the capsule and of the moulding die must vary, the degree of variation being such that at least 30%, and preferably about 50%, of the volume of metal powder contained within the capsule must be displaced in order to fit into the moulding die. The proportion of metal powder displaced during the compression process should preferably exceed 50%.

A device for carrying out the process as designed by the invention is characterized in that a press or forging hammer has a dimensionally stable cavity block, into one side of which an operating tool moves, and the other side of which allows an abutment to be introduced, and that the cavity defined by the cavity block, operating tool and abutment has at least one outlet where the flow die material can escape during the application of pressure. The flow die material can escape from the cavity block via the said outlet in order to create the varying pressure distribution which in turn gives rise to the deformations and consequently the "flow" of the metal powder.

Examples of the different versions of this invention are explained in greater detail below, with reference to the drawings.

FIG. 5 shows a schematic longitudinal section through a forging hammer for implementing the process and FIGS. 6 to 10 show schematic diagrams of varying process methods, in each case with diagram (a) depicting the initial state and diagram (b) the final state.

Figure 1:
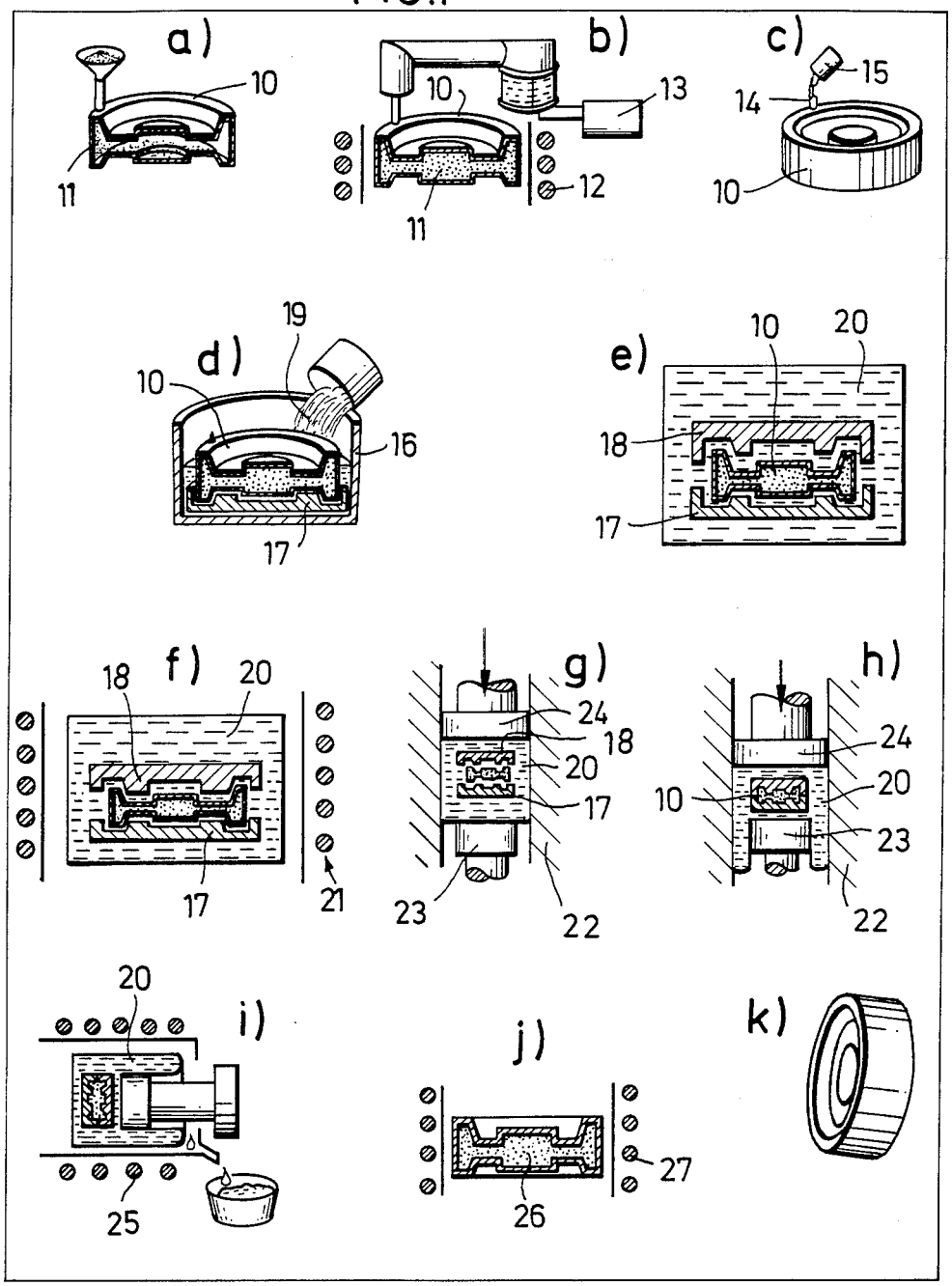
FIG. 1 shows a schematic drawing of the various process stages producing compressed moulding made from metal powder.

As shown in FIG. 1, stage (a) depicts initially a special steel capsule 10 with an airtight seal, the cavity of the capsule being in keeping with the part to be produced, but not corresponding to the said part exactly, and the capsule filled with metal powder 11. The metal powder in the example her described is TI-6Al-4V powder, produced under vacuum in accordance with the known pulverisation process.

In stage (b) the capsule 10 is heated, together with its contents of metal powder 11, to approximately 500° C. by means of a heating device 12 and connected to a vacuum source 13 in order to degas the metal powder, until the residual pressure of the gas in the metal powder is approximately $10^{-4}$ mbar. Then in stage (c) the opening 14 through which the degassing has been carried out is then hermetically sealed with a welding tool 15.

In stage (d) the capsule 10 is inserted into a mould 16 containing a lower moulding die 17 and an upper moulding die 18 (stage (e)). These moulding dies 17, 18, made from the Ni-based alloy RENE 41, are positioned at a distance from one another and also at a distance from the capsule 10, and in the closed position the moulding cavity thus created largely corresponds to the shape of the final product to be manufactured, but differs in shape from that of the capsule 10 by at least 50% by volume. The cavities remaining in the mould 16 between the capsule 10, the moulding dies 17, 18, and the walls of the mould are filled with a melt of electrolytic copper 19, thereby forming the flow die 20, which completely encloses the capsule 10 and the moulding dies 17, 18 (stage (e)).

In stage (f) a heating device 21 is used to pre-heat the complete block of the flow die 20 and the parts embedded therein for about one hour to a temperature within the range of 850° C. and 950° C. The flow die 20 is then inserted into a cavity 22 (stage (g)) with a cylindrical aperture, into which the flow die fits exactly. The flow die 20 inside the cavity is supported against an abutment 23, while a sliding tool 24 presses onto the flow die 20 from above.

In stage (h) one can see how the flow die 20 flows out of the chamber formed between the operating tool 24 and the abutment 23, this being through the annular clearance surrounding the abutment 23. The operating tool 24 seals itself against the sides of the moulding cavity, so that no significant amount of flow die material can escape here. The outflow of flow die material results in material displacement and deformation even in the powder 11 contained in the capsule 10. The capsule 10 is shaped by the moulding dies 17 and 18 moving together, during which process the soft metal between the capsule 10 and the moulding dies 17 and 18 is, as it were, squeezed out.

After the moulding dies 17, 18 have been closed and the capsule 10, which together with the metal powder content is contained in the moulding cavity, has been shaped, the flow die block is removed from the press and placed into a furnace 25 (stage (i)), in which the flow die 20 material is melted off.

The finished part 26 is then annealed in a heating device 27 for approximately one hour at a temperature of 850° C., in order to recrystallize the structure (stage (j)). The part is then fine-finished (stage (k)) by turning, etching or other methods.

Figure 2:
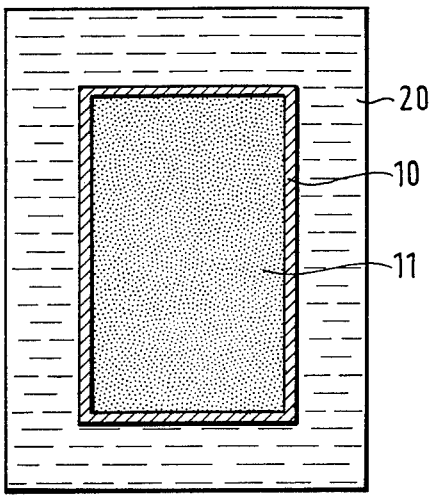
FIG. 2 shows a longitudinal section through the combination of powder capsule and flow die.

FIG. 2 shows a different version of a block containing a special steel capsule 10 with titaniferous metal powder 11. The capsule 10 is embedded in a soft metal flow die 20 which completely encloses it.

Figure 3:
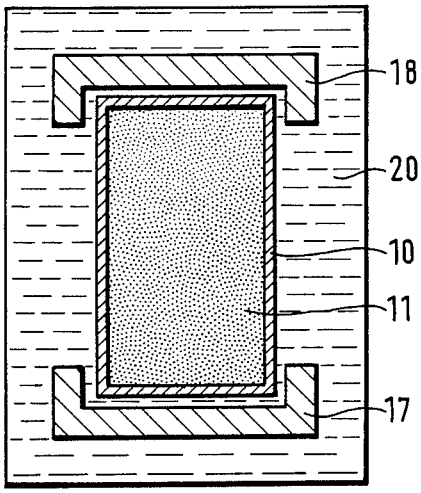
FIG. 3 shows a longitudinal section through a combination of powder capsule, flow die and moulding die.

FIG. 3 shows another version of such a block, which has, in addition to the flow die 20, two dimensionally stable moulding dies 17, 18 embedded in it, and these two said moulding dies, when pressed together, form a closed moulding cavity which can receive the capsule 10 with the metal powder 11. It is important that the shape of the capsule 10 must always deviate from the shape of the cavity created by the moulding dies 17 and 18.

Figure 4:
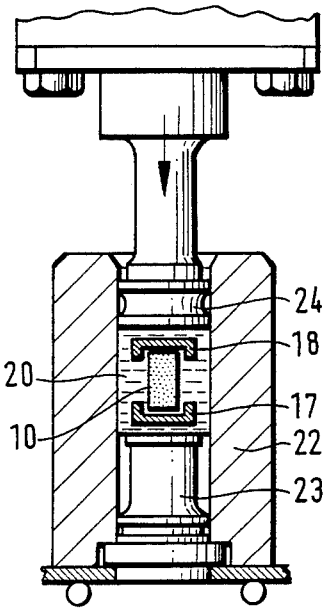
FIG. 4 shows a longitudinal section through a hydraulic press for implementing the process.

FIG. 4 shows a hydraulic press for carrying out the process. The flow die 20 enclosing the capsule 10 fits inside the cavity block 22 against an abutment 23. The shaping tool 24, the section of which fits into the moulding cavity, presses onto the moulding die from above. The force of the hydraulic press is 6.18 MN. The pressing power inside the moulding die was 7 kbar maximum and the forming speed no more than 3 $s^{-1}$. The forming temperature was between 850° C. and 950° C.

Figure 5:
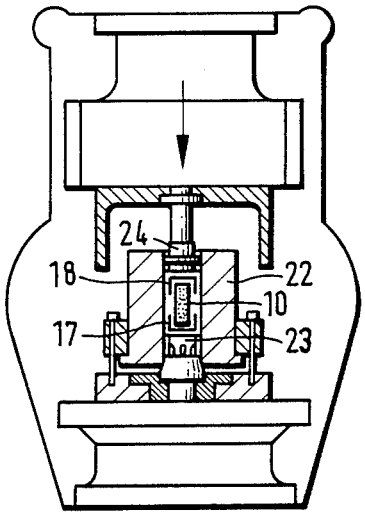

In the version shown in FIG. 5, the forming process is carried out with the aid of a forging hammer by impact, and the forming speed is approximately 100 $s^{-1}$. The hammer has an impact energy of 314 kj. The other conditions essentially correspond to those described in FIG. 4.

FIGS. 6 to 10 are schematic diagrams showing different forming possibilities. As shown in FIG. 6, not only the abutment 23, but also the operating tool 24 has a smaller cross-sectional area than the cavity of the cavity block 22. The flow die material therefore escapes at either side when pressure is applied, thereby shaping the capsule 10 symmetrically to the middle plane. The process shown in FIG. 6 is described as "double-die extrusion". FIGS. 7 and 8 show the "forward extrusion" method, as it is called, with a long stroke, where in each case only the lower abutment 23 allows the flow die material to escape at the sides, while the upper operating tool 24 acts as a seal to the pressure chamber. With this method the material is forced out in a forward direction, i.e. in the direction of movement of the operating tool 24, and the illustrated configurations of the parts can be produced by varying the amount of pressure or the length of time during which pressure is applied. The resultant parts configuration can also be influenced by the width of the annular clearance, through which the flow die material escapes.

FIG. 9 shows the forward extrusion of FIGS. 7 and 8, but with a short stroke of the operating tool 24. One can see that the shape of the parts can be varied by altering the operating parameters. It is always important that not only compression should take place, but that the metal powder substance inside the capsule 10 should be shaped at the same time.

FIG. 10 is a schematic drawing of the same forward extrusion method, this time using two moulding dies 17, 18.

It is possible to have apertures in the walls of the cavity block 22 and/or in the operating tool or abutment instead of having an annular clearance between the cavity block 22 and the operating tool or abutment. The position and size of such apertures influence the shaping of the part.

What is claimed is:

1. In a process for producing compressed molded bodies from particulate material where the particulate material is in a capsule which is evacuated and the filled capsule subsequently is compressed in a pressure chamber by pressure applied via an operating medium, the improvement comprising:

using as the operating medium a flow die of soft metal, said pressure chamber being configured such that said flow die is partially expelled out of said pressure chamber during the application of pressure, thereby shaping said particulate material while simultaneously compressing the same.

2. The improvement according to claim 1, wherein at least one dimensionally stable molding die is embedded in the flow die and the shape of the capsule deviates from that of the molding die.

3. A device as claimed in claim 17 wherein said pressure chamber consists of:

a press or forging hammer provided with a dimensionally stable receiver for fittingly mounting said flow die into which is introduced from one side of said receiver, a working tool, and from an opposing side, an abutment, and an outlet through which said flow die can escape during the application of pressure.

4. The device of claim 3 wherein said working tool and/or said abutment has a smaller cross section than said flow die fittingly mounted into said receiver.

5. A process for producing a compressed metal moulding from metal particles comprising:

(a) degassing a capsule containing the metal particles;

(b) substantially surrounding said capsule with a malleable flow die thereby forming a distinctly shaped structure;

(c) applying pressure to said capsule/flow die structure in a manner such that the flow die portion thereof assumes a new shape.

6. The process of claim 5 wherein said metal particles are particles of a titanium alloy.

7. The process of claim 5 wherein the application of pressure is carried out in a pressure chamber and during said application of pressure at least a portion of said flow die flows out from within the confines of said pressure chamber.

8. The process of claim 5 wherein said flow die is made of a soft metal.

9. The process of claim 5 wherein said process produces a metal moulding of uniform structure throughout which possesses increased mechanical strength.

10. The process of claim 5 further including a moulding die within said malleable flow die and wherein the exterior contour of said capsule is different than the interior contour of said moulding die.

11. A device suitable for producing a compressed metal moulding, the production being accomplished by compressing a malleable flow die which substantially surrounds a capsule, the capsule containing metal particles, wherein the device comprises:

(a) a pressure chamber which houses the malleable flow die/capsule structure;

(b) means for compressing said structure;

(c) at least one outlet through which flow die material can pass during compression.

12. The device of claim 11 wherein said means for compressing is a press or a forging hammer and whereby during compression the effective volume of said pressure chamber is reduced.

13. The device of claim 11 wherein the compression reduces the effective length of one dimension of said pressure chamber.

14. The device of claim 11 wherein, said pressure chamber is substantially of a cylindrical shape and said press or said forging hammer effectively forms the base of the cylinder, said base having a smaller diameter than the cylinder diameter such that said outlet is formed at the perimeter of said base.

15. The device of claim 11 wherein said malleable flow die further substantially surrounds a moulding die.

16. The device of claim 11 wherein said metal particles are particles of a titanium alloy and said malleable flow die is made of a soft metal.

17. A device for producing compressed molded bodies from particulate material, comprising:

a capsule, containing said particulate material, said capsule being evacuated, and means for applying pressure via an operating medium, said operating medium being a flow die of soft metal, and said pressure means being configured such that said flow die is partially expelled out of said pressure means during the application of pressure, thereby shaping said particulate material while compressing the same.

18. A method for compressing a molding unit to form compressed molded bodies, said molding unit consisting of particulate material contained in a capsule, said capsule being surrounded by a molding die, comprising:

completely covering said molding apparatus with a soft viscous metal flow die in a pressure chamber, said pressure chamber being configured so that said flow die flows past said molding apparatus when pressure is applied to said flow die, and applying pressure to said flow die so that said molding die compresses said capsule, thereby shaping and compressing said particulate material.

* * * * *

UNITED STATES PATENT AND TRADEMARK OFFICE

CERTIFICATE OF CORRECTION

PATENT NO. : 4,599,215

DATED : July 8, 1986

INVENTOR(S) : Smarsly et al.

It is certified that error appears in the above-identified patent and that said Letters Patent is hereby corrected as shown below:

On the title page,
Add the assignee as follows:

--[73] Assignee: Deutsche Forschungs- und Versuchsanstalt fur Luft- und Raumfahrt e.V.--

Signed and Sealed this

Twenty-fifth Day of November, 1986

*Attest:*

DONALD J. QUIGG

*Attesting Officer* *Commissioner of Patents and Trademarks*